US012018883B2

(12) United States Patent
Ren et al.

(10) Patent No.: US 12,018,883 B2
(45) Date of Patent: Jun. 25, 2024

(54) FOOD PAN COOLING SYSTEM WITH THERMAL SHIMS AND ASSOCIATED PREPARATION TABLE

(71) Applicant: ILLINOIS TOOL WORKS INC., Glenview, IL (US)

(72) Inventors: Liqun Ren, Dallas, TX (US); James R. Wright, Grand Prairie, TX (US); Keith G. Thompson, Haslet, TX (US); Rafael A. Castillo-Borelly, North Richland Hills, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 32 days.

(21) Appl. No.: 17/313,674

(22) Filed: May 6, 2021

(65) Prior Publication Data

US 2021/0348830 A1 Nov. 11, 2021

Related U.S. Application Data

(60) Provisional application No. 63/021,828, filed on May 8, 2020.

(51) Int. Cl.
*F25D 23/06* (2006.01)
*F25D 31/00* (2006.01)

(52) U.S. Cl.
CPC ..... *F25D 23/063* (2013.01); *F25D 31/006* (2013.01); *F25D 2331/809* (2013.01); *F25D 2400/08* (2013.01)

(58) Field of Classification Search
CPC ..... F25D 23/063; F25D 31/006; F25D 2331/809; F25D 2400/08; F25D 2331/812; A47F 3/0413; A47F 3/0469
See application file for complete search history.

(56) References Cited

U.S. PATENT DOCUMENTS 5,355,687 A * 10/1994 Carpenter et al. .. F25D 2400/08 62/258
7,726,296 B2 * 6/2010 Pickens et al. ..... A47J 36/2405 126/246
8,931,293 B2 * 1/2015 Shei et al. ..... A47J 36/2483 62/258
9,068,773 B2 6/2015 Lintker
2010/0293979 A1 * 11/2010 Headberg et al. ..... A47J 36/24 62/258

(Continued)

*Primary Examiner* — Elizabeth J Martin
*Assistant Examiner* — Dario Antonio Deleon
(74) *Attorney, Agent, or Firm* — THOMPSON HINE LLP

(57) ABSTRACT

A food pan cooling system includes a housing with a food item holding arrangement including a recessed well area defining at least a first food pan receiving location and a second food pan receiving location. The first food pan receiving location includes a first cooled wall structure in the recessed well area to at least in part define the first food pan receiving location, the first cooled wall structure having a first surface facing the first food pan receiving location. A first thermal shim is connected to the first cooled wall structure, the first thermal shim having a first shim surface and a second shim surface, the first shim surface at least partly in contact with the first surface of the first cooled wall structure, and the second shim surface facing the first food pan receiving location.

17 Claims, 7 Drawing Sheets

(56) References Cited

U.S. PATENT DOCUMENTS

| | | | | |
|---|---|---|---|---|
| 2011/0030565 | A1* | 2/2011 | Shei | F25D 31/005 165/58 |
| 2013/0247591 | A1* | 3/2013 | DeMasi | F25D 5/02 62/4 |
| 2015/0253062 | A1* | 5/2015 | Lintker | A47F 10/06 62/446 |

* cited by examiner

FOOD PAN COOLING SYSTEM WITH THERMAL SHIMS AND ASSOCIATED PREPARATION TABLE

TECHNICAL FIELD

This application relates generally to food preparation tables that hold and cool food pans and, more particularly, food preparation tables that cool food pans by thermal transfer between a cooled wall structure and the wall of the food pan.

BACKGROUND

Food preparation tables are commonly used in commercial establishments for preparing food products that incorporate multiple ingredients. A typical food preparation table includes a frame and housing structure having internal refrigeration or some other cooling system. An upper surface of the housing typically includes a front preparation surface that may be cooled and a rear food storage arrangement that may define multiple food pan wells (or other food pan receiving locations), each food pan well for holding on or more individual food pans for multiple individual food items that can be used in the preparation of food products. The pans are cooled in order to keep the food items in the pans fresh. One type of pan cooling system transfers heat from the food in the pan by thermal conduction through the pan wall and into one or more adjacent cooled wall structures (aka cooled rails) that border the food pan well. Close proximity, and preferably surface to surface contact, between the food pan wall and the cooled rail provides for better thermal conduction. However, various food pan suppliers exist, and the dimensions of the food pans can vary, resulting in gaps between the cold rail and the food pan wall. The gap undesirably reduce thermal conduction.

It would be desirable to provide a food pan cooling system that can improved thermal conduction in situations where a gap exists between the cold rail and the food pan wall.

SUMMARY

In one aspect, a food pan cooling system includes a cooled wall structure at least in part defining a first food pan receiving location and having a first surface facing the first food pan receiving location; and a first thermal shim connected to and in contact with the first surface.

In another aspect, a food pan cooling system includes a housing with a food item holding arrangement including a recessed well area defining at least a first food pan receiving location and a second food pan receiving location. The first food pan receiving location includes a first cooled wall structure in the recessed well area to at least in part define the first food pan receiving location, the first cooled wall structure having a first surface facing the first food pan receiving location. A first thermal shim is connected to the first cooled wall structure, the first thermal shim having a first shim surface and a second shim surface, the first shim surface at least partly in contact with the first surface of the first cooled wall structure, and the second shim surface facing the first food pan receiving location.

In a further aspect, a method of enhancing thermal transfer between a cooled wall structure of a food pan cooling system and a food pan supported by the food pan cooling system, involves: releasably mounting a thermal shim against a surface of the cooled wall structure such that the thermal shim is located between the surface of the cooled wall structure and a food pan receiving location; and positioning a food pan in the food pan receiving location such that a wall portion of the food pan is in contact with the thermal shim for transferring heat from food product in the food pan, through the thermal shim and to the cooled wall structure.

The details of one or more embodiments are set forth in the accompanying drawings and the description below. Other features, objects, and advantages will be apparent from the description and drawings, and from the claims.

DETAILED DESCRIPTION

Figure 1:
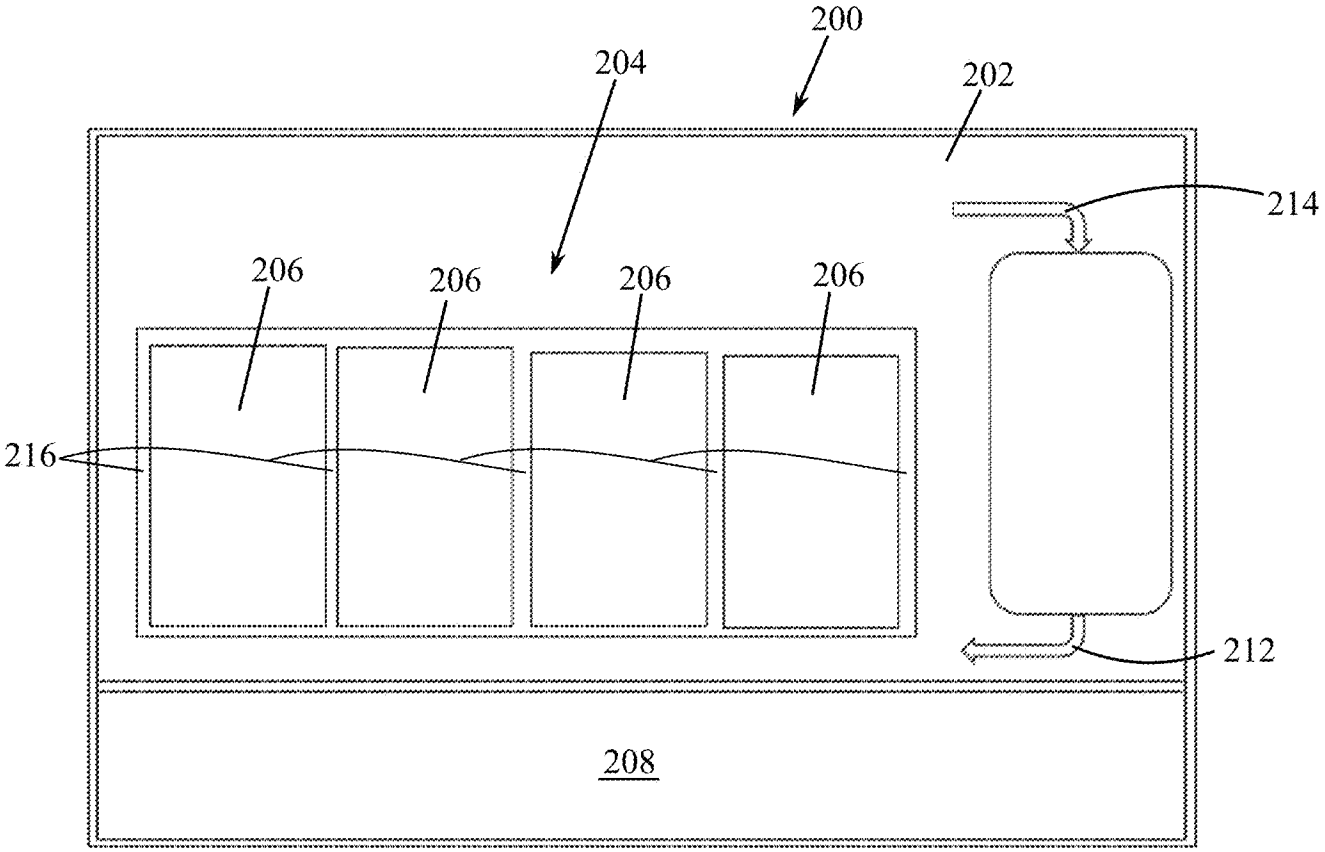
FIG. 1 shows a schematic top plan view of a food preparation table system.
Figure 2:
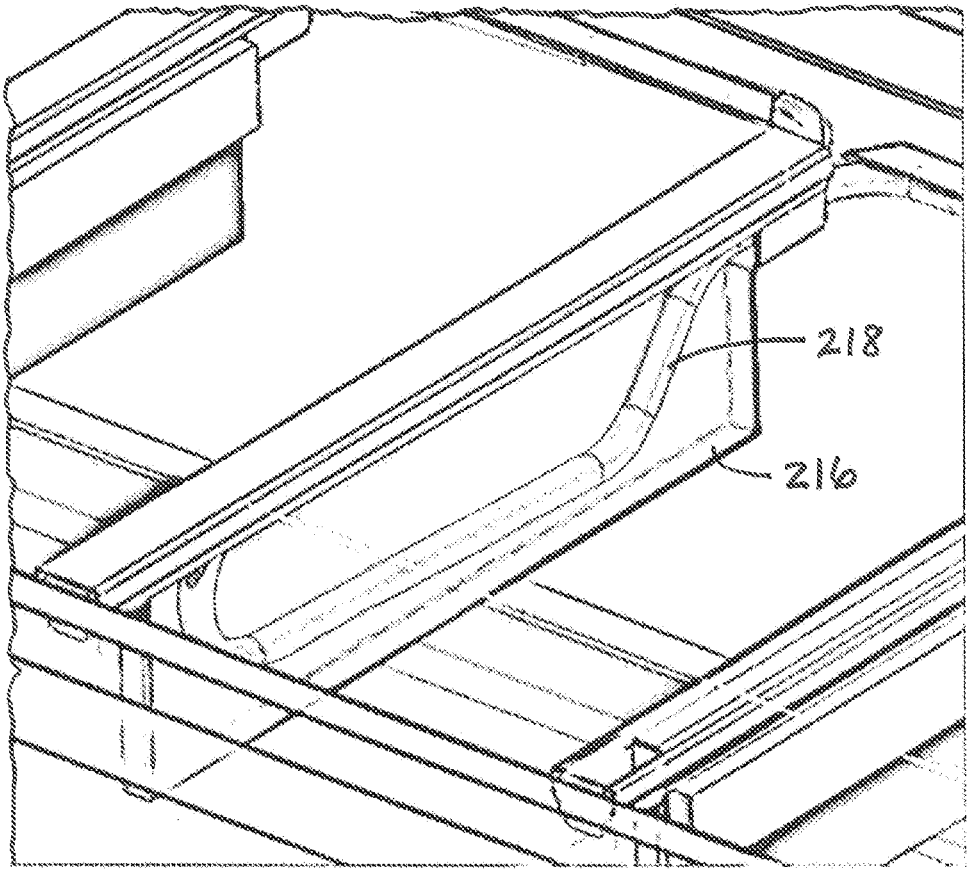
FIG. 2 shows a perspective view of one embodiment of a cooled wall structure within internal cooling piping.

Referring to FIGS. 1 and 2, a food preparation table system 200 is shown schematically and includes a housing 202 (e.g., frame and panels) with a food item holding arrangement 204 (e.g., upper housing section with a recessed well area and support bars) defining multiple food pan receiving locations 206 (aka food pan wells). Each food pan receiving location supports, or is configured to support, at least one food pan. A front section of the food preparation table system defines a working counter 208 at which food products can be prepared be selecting from among the various food items in the multiple pans. A cooling system 210 is provided for cooling the food pans using a cooling fluid, per flow path arrows 212, 214. The cooling system may circulate a refrigerant (e.g., via a copper pipe 218) to each of the food pan wells such that the copper pipe runs within one or more wall structures 216 that border each of the wells. The system may, alternatively, circulate a chilled liquid coolant that passes directly through the wall structures, such as that described in U.S. Pat. No. 9,068,773 B2. Systems that combine the cooled wall structure cooling with additional cooling via a cooled air flow are also possible.

Figure 3:
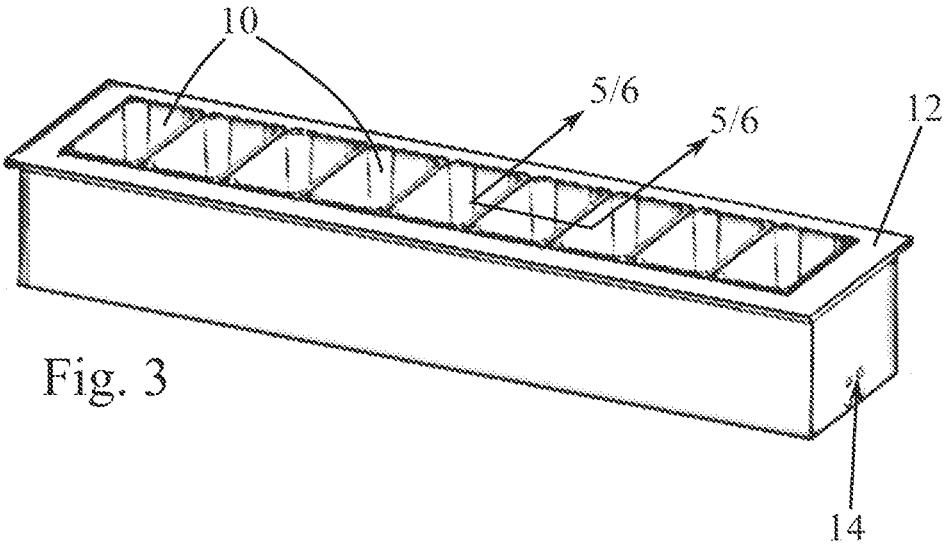
FIG. 3 shows a perspective view one embodiment of a food pan cooling system with multiple food pans.
Figure 4:
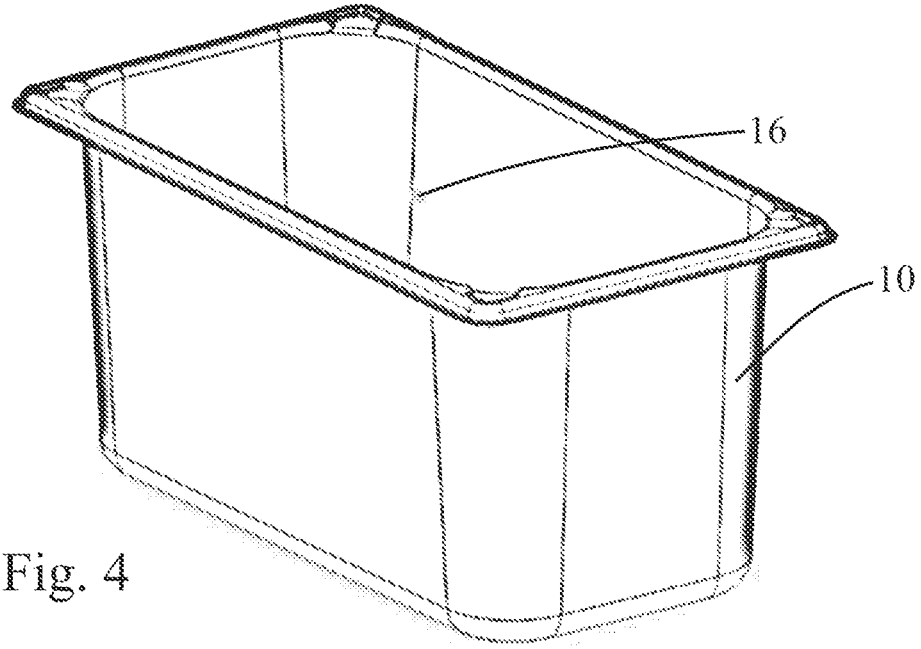
FIG. 4 shows a food pan.
Figure 5:
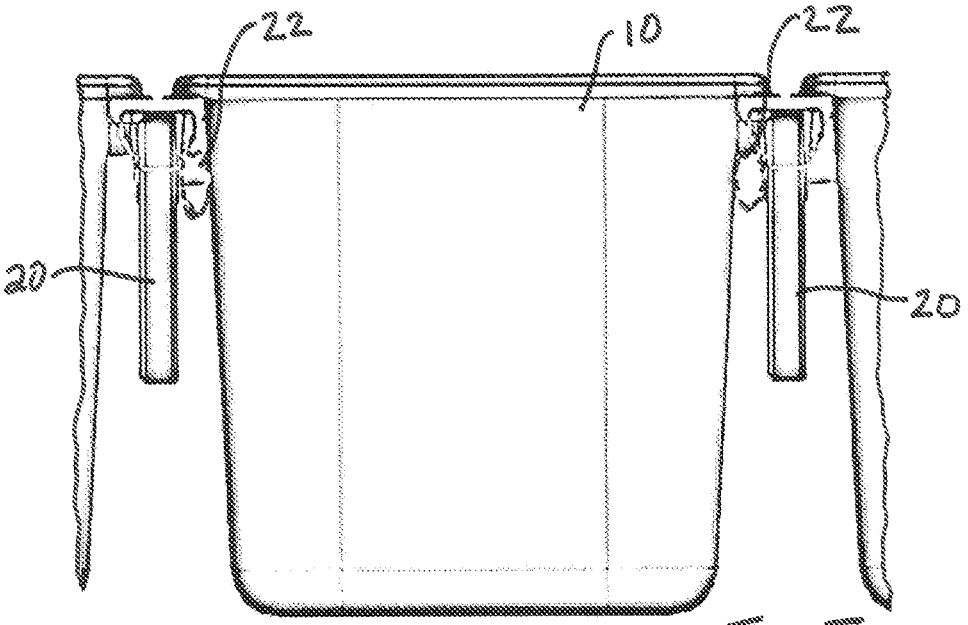
FIG. 5 shows a cross-section with air gaps.

Referring to FIG. 3, an exemplary set of food pans 10 (here nine) within a pan cooling housing 12 are shown. The housing includes openings 14 through which cooled refrigerant or other cooled fluid can be delivered to cold rails at the borders of the pans. FIG. 4 shows a target food cooling region 16 at the upper center of a food pan 10, which tends to be the most difficult to effectively cool. As shown, the typical food pan includes sidewalls with a slight taper, resulting in the footprint of the bottom of the pan being smaller than the footprint of the top of the pan. FIG. 5 depicts a partial cross-section showing the cooled wall structures 20 between the food pans 10, and the existence of gaps 22 between the exterior surfaces of the food pan walls 10*a* and the exterior surfaces of the cooled wall structures 20.

Figure 6:
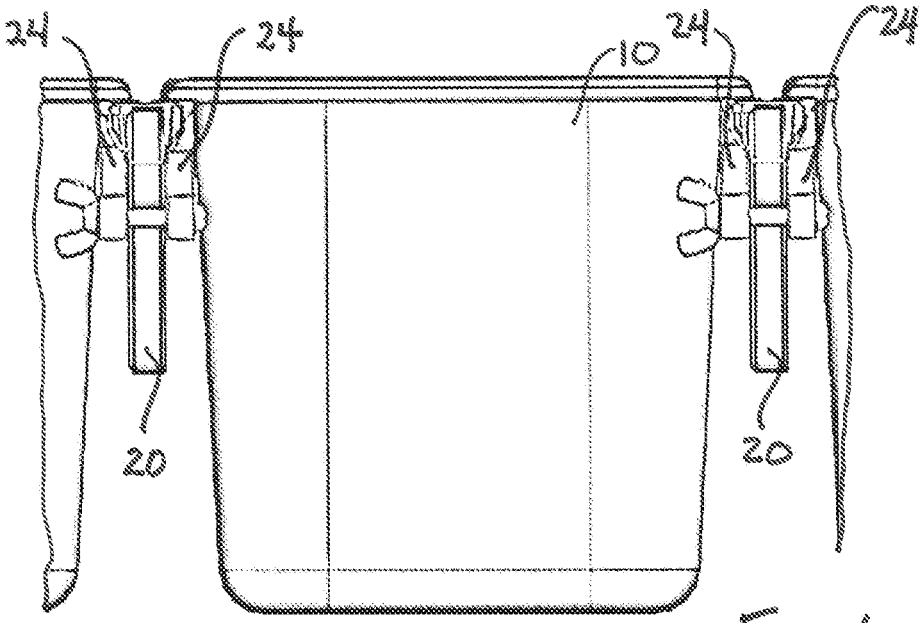
FIG. 6 shows a cross-section with thermal shims, according to one embodiment.
Figure 7:
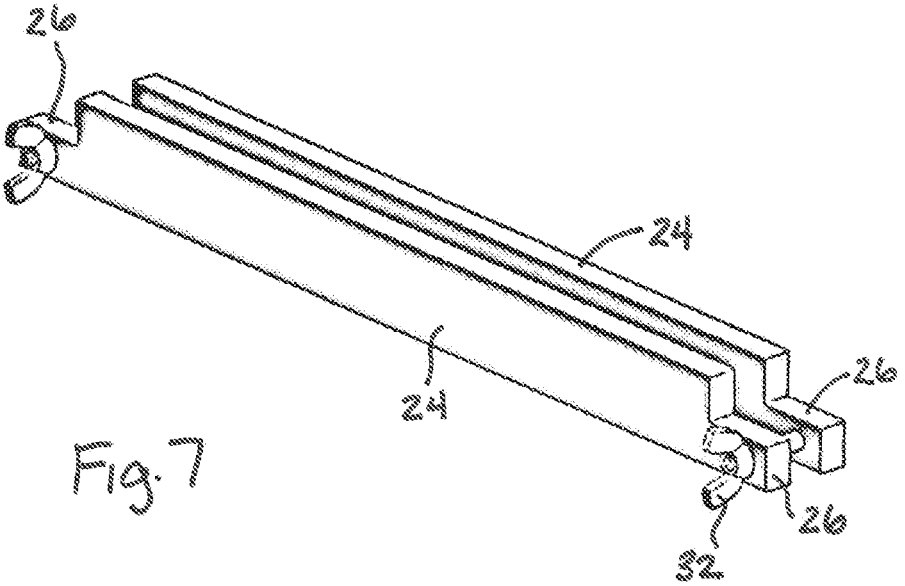
FIG. 7 shows the thermal shims in perspective.
Figure 8:
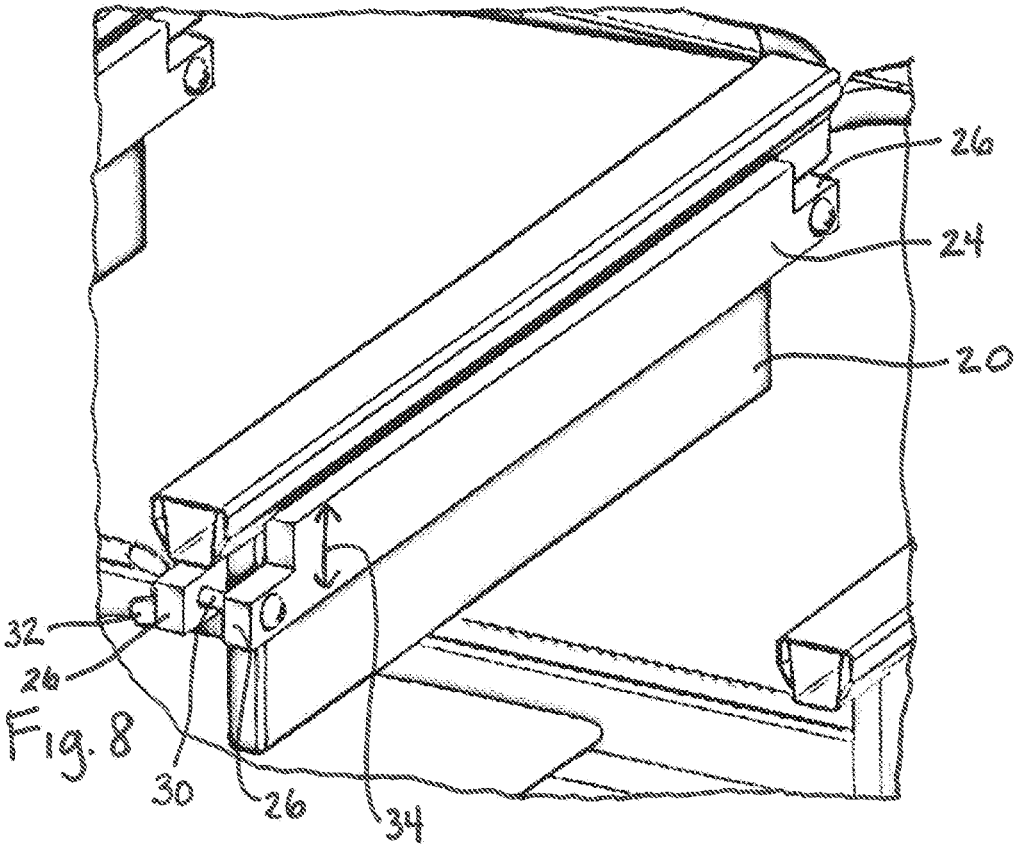
FIG. 8 shows the thermal shims in perspective on the cooled wall structure (no pans shown)

FIG. 6 shows a similar cross-section, but with thermal shims 24 connected to the wall structures 20, filling the gaps, so as to provide improved thermal conductivity between the food pan walls and the surfaces of the cooled wall structures. One surface of each shim lies adjacent a surface of a cooled wall structure, and the other surface of each shim faces the food pan receiving location so as to be in contact with one of the food pan walls therein. By way of example, the thermal shims may be formed of any metal of good thermal conductivity, as such thermal conductivity will be materially better than that achievable across an air gap. As seen in FIGS. 7 and 8, for the purpose of attaching the thermal shims 24 to the cooled wall structures 20, the shims include extension legs 26 that extend beyond the ends of the wall structures 20. Two shims 24 at opposite sides of the wall structures 20 are connected to each other by bolts 30 and nuts 32, where the bolts 30 pass through aligned openings in the extension legs 26. With this arrangement, the thermal shims 24 are effectively clamped to the cooled wall structures 20 by tightening of the nuts 32, and the nuts 32 and bolts are positioned away from the footprint or perimeter of the food pans. The position of the shims 24 along the height of the cooled wall structures 20 can be adjusted, per arrow 34, by loosening the nuts 32, sliding the shims 24 vertically, and then retightening. This provides an added benefit of enabling (i) the shim position to be matched to various different pan sizes (e.g., pan sizes that result in different gap sizes) and/or (ii) the shim position to be lowered far enough to avoid contact with the pan walls when the pan size is properly sized so that the upper portions of the pan walls actually make direct contact, or near contact, with the surfaces of the cooled wall structures 20.

Figure 9:
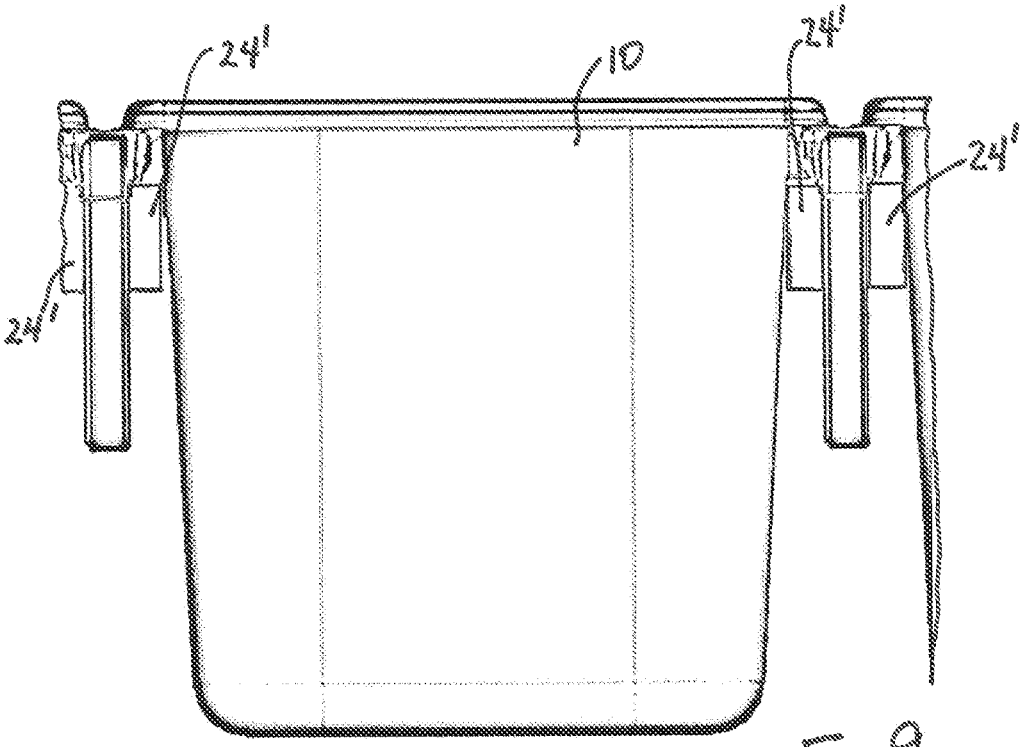
FIG. 9 shows a cross-section with thermal shims according to another embodiment.
Figure 10:
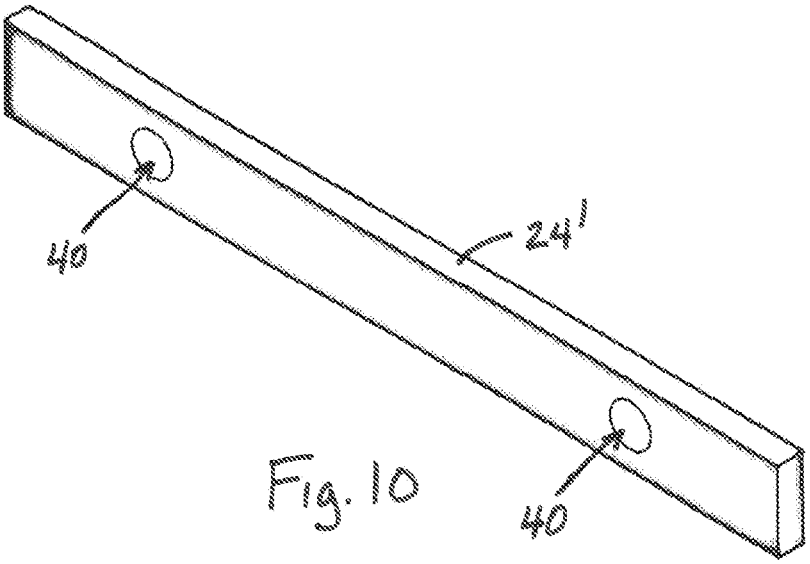
FIG. 10 shows the thermal shim in perspective.
Figure 11:
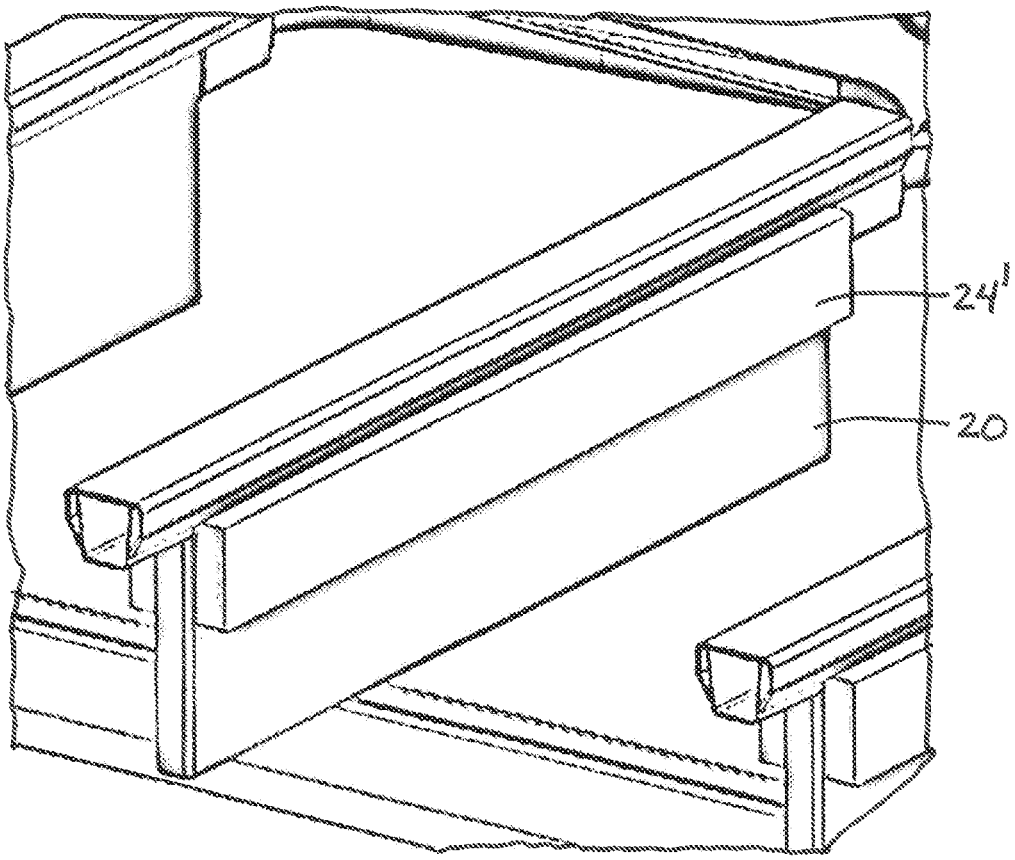
FIG. 11 shows the thermal shims in perspective on the cooled wall structure.

FIGS. 9-11 show an alternative embodiment in which the thermal shims 24' incorporate one or more magnet inserts 40 such that each shim 24 is independently retained against the surface of the cooled wall structure 20 by magnetic attraction. The magnet inserts provide for a potentially simpler means of permitting vertical adjustment of the shim position along the cooled wall structure, and enable the shims 24' at opposite sides of the same cooled wall structure to be positioned at different heights. The extension legs are not needed on the thermal shims 24' when using the magnetic connection or mounting arrangement.

Other mount arrangements for the thermal shims are possible, such as incorporating mount slots into the cooled wall structures or providing mount brackets for the shims, which enable the shims to hang from the cooled wall structures. Moreover, the cooled wall structures, or the shims themselves, could be formed with some taper to better match with the taper of the typical food pan walls.

Regardless of the exact mount structure the system with shims provides an advantageous method of enhancing thermal transfer between a cooled wall structure of a food pan cooling system and a food pan supported by the food pan cooling system. The method involves: mounting a thermal shim against a surface of the cooled wall structure such that the thermal shim is located between the surface of the cooled wall structure and a food pan receiving location; and positioning a food pan in the food pan receiving location such that a wall portion of the food pan is in contact with the thermal shim for transferring heat from food product in the food pan, through the thermal shim and to the cooled wall structure. Thus, the shims provide a more direct and thermally conductive path between the food pan walls and the cooled wall structures. Where various size food pans are used, the height of the shims along the cooled wall structure can be adjusted to provide for meaningful thermal contact between the shims and both the cooled wall structure and the food pan walls. In cases where food pans are used that actually closely match the size of the food pan receiving locations, such that little or no gap is present between the cooled wall structures and the food pan walls, the shims can be moved to a low position along the cooled wall structures to be out of the way, or the shims can be removed entirely and stored for later use when needed with another pan set.

It is to be clearly understood that the above description is intended by way of illustration and example only, is not intended to be taken by way of limitation, and that other changes and modifications are possible. What is claimed is:

What is claimed is:

1. A food pan cooling system, comprising:

a cooled wall structure at least in part defining a first food pan receiving location and having a first surface laterally facing the first food pan receiving location; and a first food pan supported within the first food pan receiving location;

a first thermal shim connected to and at least partly in contact with the first surface of the cooled wall structure such that the first thermal shim is located in a gap between the first surface of the cooled wall structure and a sidewall of the first food pan;

wherein a position of the thermal shim along a height of the first surface of the cooled wall structure is user adjustable between multiple locations along the height of the first surface of the cooled wall structure to facilitate engagement of the first thermal shim with the sidewall of the first food pan.

2. The food pan cooling system of claim 1, further comprising:

the cooled wall structure at least in part defining a second food pan receiving location, alongside the first food pan receiving location, and having a second surface facing the second food pan receiving location;

a second food pan supported within the second food pan receiving location;

a second thermal shim connected to and at least partly in contact with the second surface of the cooled wall structure such that the second thermal shim is located in a gap between the second surface of the cooled wall structure and a sidewall of the second food pan;

wherein a position of the second thermal shim along a height of the second surface of the cooled wall structure is adjustable to facilitate engagement of the second thermal shim with the sidewall of the second food pan.

3. The food pan cooling system of claim 2, wherein the first surface of the cooled wall structure is opposite the second surface of the cooled wall structure, wherein the first thermal shim and the second thermal shim are interconnected by releasable fastener assemblies that clamp the first thermal shim and the second thermal shim together against the cooled wall structure.

4. The food pan cooling system of claim 1, wherein the first thermal shim includes at least one magnet that releasably retains the first thermal shim against the first surface of the cooled wall structure to enable adjustment of the position of the first thermal shim along the height of the first surface of the cooled wall structure.

5. A food preparation table, comprising:

the food pan cooling system of claim 1; and a food preparation counter adjacent the food pan cooling system.

6. The food pan cooling system of claim 1, wherein the first thermal shim includes an upper edge and a lower edge, and the upper edge is positioned below a top of the first food pan.

7. The food pan cooling system of claim 1, wherein the food pan defines a pan height, the thermal shim defines a shim height and the shim height is less than the pan height.

8. A food pan cooling system, comprising:

a housing with a food item holding arrangement including a recessed well area defining at least a first food pan receiving location and a second food pan receiving location;

wherein the first food pan receiving location includes a first cooled wall structure in the recessed well area to at least in part define the first food pan receiving location, the first cooled wall structure having an internal space through which a cooling fluid circulates and a first surface facing the first food pan receiving location; and a first food pan positioned in the first food pan receiving location;

a first thermal shim connected to the first cooled wall structure in a gap between the first surface of the first cooled wall structure and the first food pan, the first thermal shim having a first shim surface and a second shim surface, the first shim surface at least partly in contact with the first surface of the first cooled wall structure, and the second shim surface facing a sidewall of the first food pan; and a mount arrangement configured to permit adjustment of a position of the first thermal shim along a height of the cooled wall structure.

9. The food pan cooling system of claim 8, wherein the mount arrangement comprises at least one of (i) a clamping assembly or (ii) a magnet.

10. The food pan cooling system of claim 8, further comprising:

wherein a height of the first thermal shim is less than a height of the first cooled wall structure; and wherein the first thermal shim is located alongside and at least partly in contact with an upper wall portion of the sidewall of the first food pan.

11. The food pan cooling system of claim 8, further comprising:

the first cooled wall structure having a second surface facing the second food pan receiving location; and a second food pan supported within the second food pan receiving location;

a second thermal shim connected to the first cooled wall structure in a gap between the second surface of the first cooled wall structure and the second food pan, the second thermal shim having a third shim surface and a fourth shim surface, the third shim surface at least partly in contact with the second surface of the first cooled wall structure, and the fourth shim surface facing the second food pan receiving location.

12. The food pan cooling system of claim 11, further comprising:

the mount arrangement comprises a clamping arrangement interconnecting the first thermal shim and the second thermal shim and clamping the first thermal shim and the second thermal shim to the first cooled wall structure.

13. The food pan cooling system of claim 12, wherein the clamping arrangement includes releasable fasteners.

14. The food pan cooling system of claim 8, wherein the internal space of the cooled wall structure carries a pipe in which the cooling fluid circulates.

15. A method of enhancing thermal transfer between a cooled wall structure of a food pan cooling system and a food pan supported by the food pan cooling system, the method comprising:

the cooled wall structure having an external surface and an internal space through which a cooling fluid circulates;

releasably mounting a thermal shim against the external surface of the cooled wall structure such that the thermal shim is located between the external surface of the cooled wall structure and a food pan receiving location such that a position of the thermal shim along a height of the cooled wall structure is user adjustable; and positioning a food pan in the food pan receiving location such that a wall portion of the food pan is spaced apart from the external surface of cooled wall structure by a gap, located between the wall portion and the external surface of the cooled wall structure, and in which the thermal shim is located, and the wall portion of the food pan is in direct contact with the thermal shim for transferring heat from food product in the food pan, through the thermal shim and to the cooled wall structure.

16. The method of claim 15, wherein the step of releasably mounting involves (i) clamping the thermal shim to the cooled wall structure or (ii) magnetically attaching the thermal shim to the cooled wall structure.

17. The method of claim 15, wherein the internal space of the cooled wall structure carries a pipe in which the cooling fluid circulates.

* * * * *